US006104361A

United States Patent [19]

Rutherford

[11] Patent Number: 6,104,361

[45] Date of Patent: Aug. 15, 2000

[54] SYSTEM AND METHOD FOR DRIVING A PLASMA DISPLAY PANEL

[75] Inventor: James C. Rutherford, Fort Wayne, Ind.

[73] Assignee: Photonics Systems, Inc., Northwood, Ohio

[21] Appl. No.: 08/933,905

[22] Filed: Sep. 23, 1997

[51] Int. Cl.[7] ..... G09G 3/20

[52] U.S. Cl. ..... 345/55; 345/60

[58] Field of Search ..... 345/211, 204, 345/71, 208, 55, 60, 37; 340/778, 324; 315/169.1, 169.2, 169.3

[56] References Cited

U.S. PATENT DOCUMENTS

| | | | |
|---|---|---|---|
| 3,803,585 | 4/1974 | Urade et al. | 340/324 |
| 4,110,663 | 8/1978 | Miyazaki et al. | 315/169 |
| 4,347,509 | 8/1982 | Hardway et al. | 340/778 |
| 5,541,618 | 7/1996 | Shinoda . | |
| 5,654,728 | 8/1997 | Kanazawa et al. . | |

OTHER PUBLICATIONS

S. Mikoshiba, "Seminars M4: Color Plasma Displays," Society For Information Display (SID), 1997.

*Primary Examiner*—Steven J. Saras
*Assistant Examiner*—Alecia D. Nelson
*Attorney, Agent, or Firm*—Marshall & Melhorn

[57] ABSTRACT

A system and method for driving a plasma display panel are provided. The method includes scanning a current display line to selectively store charge quantities on selected pixels defined along a first row electrode at cross-points of corresponding column electrodes. A priming voltage pulse is applied between the first row electrode and a second row electrode to cause a priming discharge between the first and second row electrodes. The priming discharge is capable of priming a different display line proximate to the current display line. The system includes driver circuitry for scanning a current display line, and for applying the priming voltage pulse to cause the priming discharge to prime a different display line proximate to the current display line.

8 Claims, 5 Drawing Sheets

SYSTEM AND METHOD FOR DRIVING A PLASMA DISPLAY PANEL

TECHNICAL FIELD

The present invention relates generally to plasma display panels, and particularly to systems and methods for driving a plasma display panel.

BACKGROUND ART

Plasma display panels are currently expected to replace cathode ray tubes for many uses such as televisions, monitors, and other video displays. One important advantage of plasma display panels is that a relatively large display area can be provided with relatively minimal thickness as compared to cathode ray tubes.

The general construction of plasma display panels includes generally sheet-like front and back glass substrates having inner surfaces that oppose each other with a chemically stable gas hermetically sealed therebetween by a seal between the substrates at the periphery of the panel. Elongated electrodes covered by a dielectric layer are provided on both substrates with the electrodes on the front glass substrate extending transversely to the electrodes on the back glass substrate so as to thereby define gas discharge cells or pixels that can be selectively illuminated by an electrical driver of the plasma display panel. The panels can be provided with phosphors to enhance the luminescence and thus also the efficiency of the panels. The phosphors can also be arranged in pixels having several subpixels for respectively emitting the primary colors red, green, and blue to provide a full color plasma display panel.

The conventional construction of back glass substrates for color plasma display panels has elongated gas discharge troughs and barrier ribs that space the troughs from each other so as to generally isolate each column of pixels within each trough from the columns of pixels on each side thereof and thereby provide good color separation and pixel definition.

In plasma display panels, it is becoming increasingly more desirable to have larger display screens with more display lines and more intensity levels, without decreasing the picture quality. Known driving techniques for both color and monochrome alternating current plasma display panels include addressing periods in which charge quantities are retained by selected pixels, and sustain periods during which the charge quantities are excited to illuminate the selected pixels. To increase the reliability of pixel addressing, discharge priming is performed prior to addressing a group of display lines. The discharge priming provides priming particles which may be space charges, metastable atoms, or photons.

Some known techniques for driving plasma display panels employ a reset sequence of typically hundreds of microseconds which requires high voltage bulk erase and write pulsing, and an extensive conditioning time prior to addressing to provide discharge priming for addressing. One example of an existing driving technique is shown in U.S. Pat. No. 5,541,618 issued to Shinoda which describes the use of subframes having a concurrent addressing period and a concurrent display period for all scan electrodes or display lines. Another example of an existing driving technique is shown in U.S. Pat. No. 5,436,634 issued to Kanazawa which describes carrying out the accumulation of wall charges or charge quantities in the addressing period on every other display line, and the maintenance discharge in the maintenance discharge period on every display line.

SUMMARY OF THE INVENTION

It is, therefore, an object of the present invention to provide systems and methods for driving a plasma display panel which improve discharge priming.

It is another object of the present invention to provide systems and methods for driving a plasma display panel which improve panel addressing.

It is another object of the present invention to consistently reduce the formative discharge time lag for scanning a display line of a plasma display panel.

It is a further object of the present invention to decrease background glow and increase contrast to improve picture quality in a plasma display panel.

It is a further object of the present invention to provide line by line discharge priming while scanning display lines during the addressing period of a plasma display panel.

It is an even further object of the present invention to lower the switching voltages of the electrode driver circuitry in a plasma display panel.

In carrying out the above objects and other objects and features of the present invention, a system and method for driving a plasma display panel are provided. In a plasma display panel in which scanning a current display line retains charge quantities on selected pixels defined along a first row electrode, a method of driving the plasma display panel comprises applying a priming voltage pulse between the first row electrode and a second row electrode. The priming voltage pulse is sufficient to cause a priming discharge between the first and second row electrodes. The priming discharge is capable of priming a different display line proximate to the current display line. Preferably, the priming voltage pulse is applied while scanning the current display line.

In one embodiment, the method further comprises resetting the plasma display panel by removing charge quantities retained by the pixels prior to scanning display lines. Scanning a current display line includes applying a scan voltage pulse to the first row electrode, and applying an addressing voltage pulse to selected column electrodes corresponding to the selected pixels of the display line. An addressing discharge is caused between the first row electrode and the selected column electrodes and stores charge quantities on the selected pixels. Preferably, the priming discharge enhances the storing of charge quantities on the selected pixels.

In another embodiment, the method further comprises resetting the plasma display panel by storing charge quantities on the pixels prior to scanning display lines. Scanning a current display line includes applying a scan voltage pulse to the first row electrode, and applying an addressing voltage pulse to unselected column electrodes corresponding to unselected pixels of the display line. An addressing discharge is caused between the first row electrode and the unselected column electrodes and removes charge quantities from the unselected pixels.

Embodiments of the present invention may include applying sustaining voltage pulses between row scan and row maintenance electrodes, or applying sustaining pulses between row and column electrodes, to illuminate the selected pixels. Further, non-addressable starter electrode pairs may be employed for purposes of discharge priming.

Further, in carrying out the present invention, a system for driving a plasma display panel is provided. The system comprises driver circuitry for scanning a current display line, and for applying a priming voltage pulse to cause a priming discharge capable of priming a different display line proximate to the current display line.

Still further, in carrying out the present invention, a plasma display panel is provided. The plasma display panel comprises a pair of substrates positioned to define a gap region therebetween, a plurality of row electrodes, a plurality of column electrodes, and driver circuitry for scanning a current display line and for applying the priming voltage pulse to prime a different display line proximate to the current display line.

The advantages accruing to the present invention are numerous. For example, the discharge priming techniques of the present invention are capable of line by line discharge priming while scanning display lines of the plasma display panel. The discharge priming reduces the formative discharge time lag for scanning a display line, which improves addressing by reducing the addressing time required per line allowing for more lines to be scanned in a given addressing period. Embodiments of the present invention decrease background glow and increase contrast in a plasma display panel by employing an improved reset sequence and improved discharge priming. Still further, the present invention lowers the electrode driver circuitry switching voltages by utilizing improved priming, resetting, and addressing techniques.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
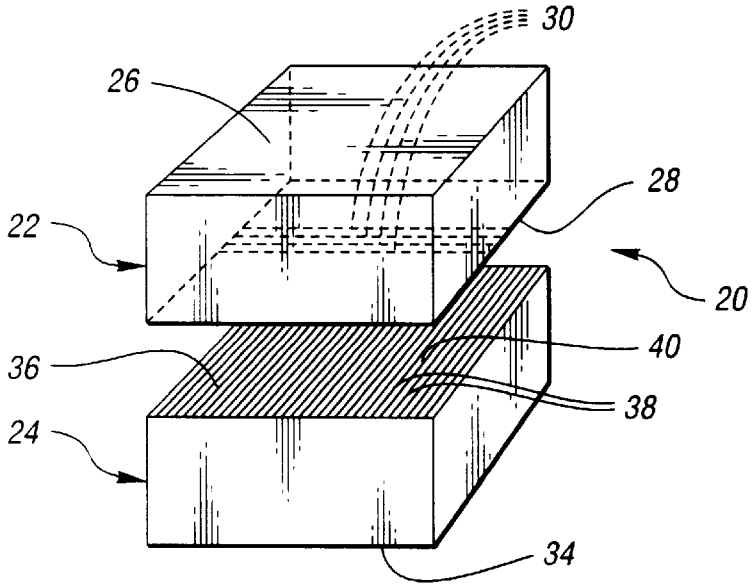
FIG. 1 is an exploded perspective view that is somewhat schematic to illustrate the active area of a plasma display panel constructed in accordance with the present invention.
Figure 2:
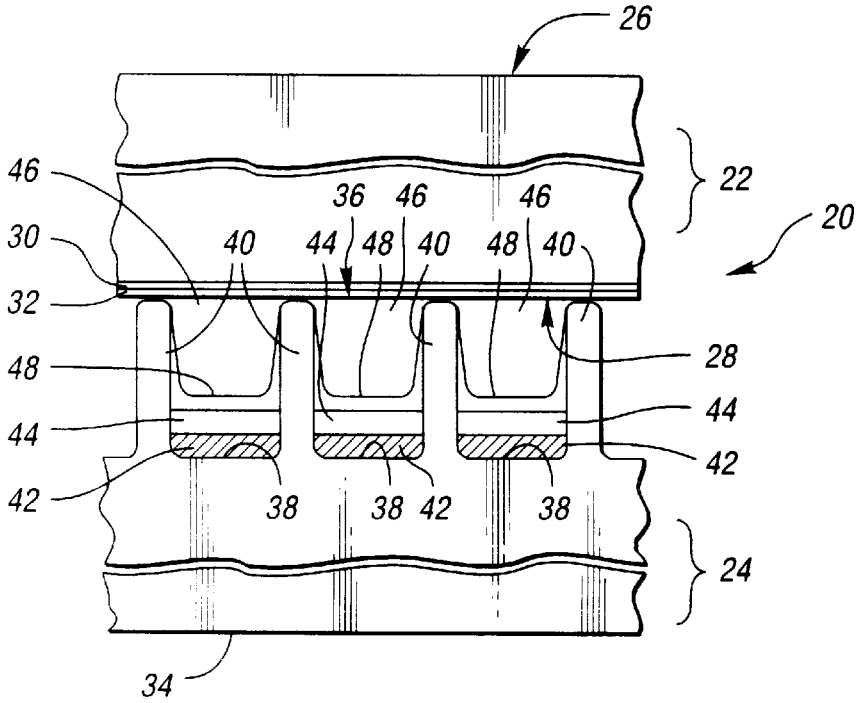
FIG. 2 is a partially broken away sectional view taken through the plasma display panel of FIG. 1 to illustrate its construction.

With reference to the somewhat schematic view of FIG. 1 of the drawings, an alternating current plasma display panel constructed in accordance with the invention is generally indicated by 20. This plasma display panel 20 includes a generally sheet-like front glass substrate 22 and a generally sheet-like back glass substrate 24. The front glass substrate 22 has an outer surface 26 that faces forwardly during use toward the viewer of the display. The front glass substrate 22 also includes an inner surface 28 that faces rearwardly during use and includes elongated electrodes 30 over its extent with only several of these being illustrated by schematic hidden line representation. These electrodes 30, as illustrated in FIG. 2, are covered by a dielectric layer 32. The electrodes 30 extend in a spaced and parallel relationship to each other in a first direction generally between opposite extremities of the display panel 20 where suitable electrical connections are made to an electrical driver which will be described. Although the front and back glass substrates 22 and 24 for ease of illustration are shown somewhat block shaped, they actually have sheet-like shapes with relatively large dimensions between their opposite extremities and relatively thin thicknesses.

With continuing reference to FIG. 1 and additional reference to FIG. 2, the back glass substrate 24 of the plasma display panel 20 includes an outer surface 34 that faces rearwardly during use of the panel away from the observer and also includes an inner surface 36 that faces forwardly in an opposed relationship to the inner surface 28 of the front glass substrate 22. This inner surface 36 of the back glass substrate 24, as illustrated in FIG. 2, includes gas discharge troughs 38 and also includes barrier ribs 40 that space the gas discharge troughs from each other.

These gas discharge troughs 38 and barrier ribs 40 are elongated, as schematically illustrated in FIG. 1, extending in a spaced and parallel relationship to each other in a second direction that is transverse to the first direction of the electrodes 30 of the front glass substrate 22. The back glass substrate 24 includes elongated electrodes 42 within the gas discharge troughs 38 and each of these electrodes is covered by a dielectric layer 44 that may be covered with an unshown thin layer of magnesium oxide or other suitable secondary emissive thin film that lowers the required operating voltages. The electrodes 42 of the back glass substrate extend to at least one extremity of the display panel 20 for connection with an electrical driver of the panel. Gas discharge cells or pixels 46 are provided at cross-points of the front electrodes 30 and back electrodes 42. A chemically stable gas is hermetically sealed by a seal between the peripheries of the front and back glass substrates 22 and 24. For color displays, an addition of Helium, Neon, or Argon to Xenon has been found to lower the breakdown voltage.

As illustrated in FIG. 2, the gas discharge troughs 38 may also have phosphors 48 that enhance the luminescence and also can be arranged in pixels having adjacent gas discharge troughs providing subpixels for emitting the three primary colors red, green, and blue to provide a full color display. In the latter case, the pitch of the spacing between the gas discharge troughs 38 should be approximately one-third of the pitch between the electrodes 30 of the front glass substrate to have the same pixel resolution in both directions of the panel. Note that the phosphor may be used as some or all of the dielectric layer, in which case the previously mentioned secondary emissive thin film may be applied over the phosphor.

With continuing reference to FIG. 2, it will be noted that the thickness of the front and back glass substrates 22 and 24 is broken away because the depth of the gas discharge troughs 38 and the corresponding height of the barrier ribs 40 is only on the order of magnitude of thousandths of an inch as compared to the much thicker substrates. For example, in one desired construction, the spacing pitch between the gas discharge troughs is four thousandths of an inch with each trough having a width of three thousandths of an inch, each barrier rib 40 having a width of one thousandth of an inch and a height of four thousandths of an inch. These exemplary dimensions are not intended to limit the invention, but rather to provide a general understanding of the relatively small dimensions involved. Also, it should be noted that the dielectric layer 44 and phosphors 48 are also very thin, e.g. a number of microns thick, but are shown thicker for ease of illustration.

Figure 3:
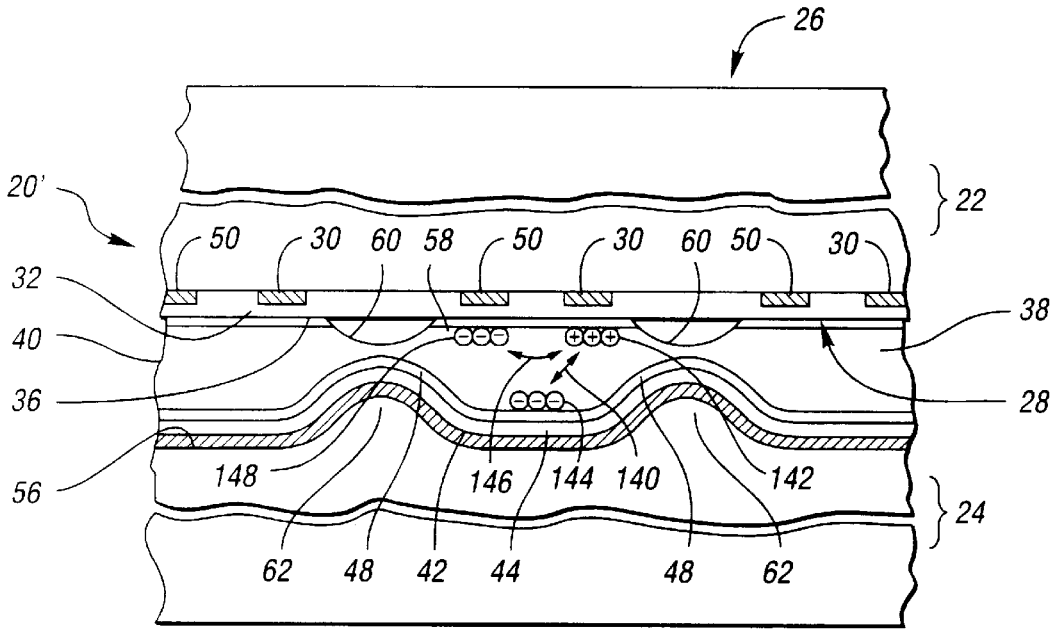
FIG. 3 illustrates a plasma display panel of the present invention as being of the surface discharge construction, and is taken longitudinally along one of the gas discharge troughs.

With reference to FIG. 3, the plasma display panel 20 is illustrated as being of the surface discharge construction such that the sustaining discharges are between the scan electrodes 30 and the corresponding maintenance electrodes 50. Also, the back glass substrate 24 can have the gas discharge troughs 38 provided with bottom surfaces 56 of an undulating shape along their lengths. In one embodiment, the barrier ribs 40 include distal ends 58 of elongated shapes having indents 60 that provide communication for priming particles between the adjacent gas discharge troughs 38. The bottom surfaces 56 of the gas discharge troughs 38 include peaks 62 located adjacent the indents 60 in the distal ends 58 of the barrier ribs 40. The phosphors 48 are located within the gas discharge troughs 38 extending over the bottom surface peaks 62 with a somewhat saddle shape and, while shown along the entire length of the trough, may be devoid in the valleys between the peaks.

It is to be appreciated that embodiments of the present invention provide operation of the plasma display panel 20 in a surface discharge mode or a column discharge mode. When the panel 20 is operated in a surface discharge mode, the sustaining discharges are between the scan electrodes 30 and maintenance electrodes 50. When the panel 20 is operated in a column discharge mode, the sustaining discharges are between the scan electrodes 30 and the column address electrodes 42.

Figure 4:
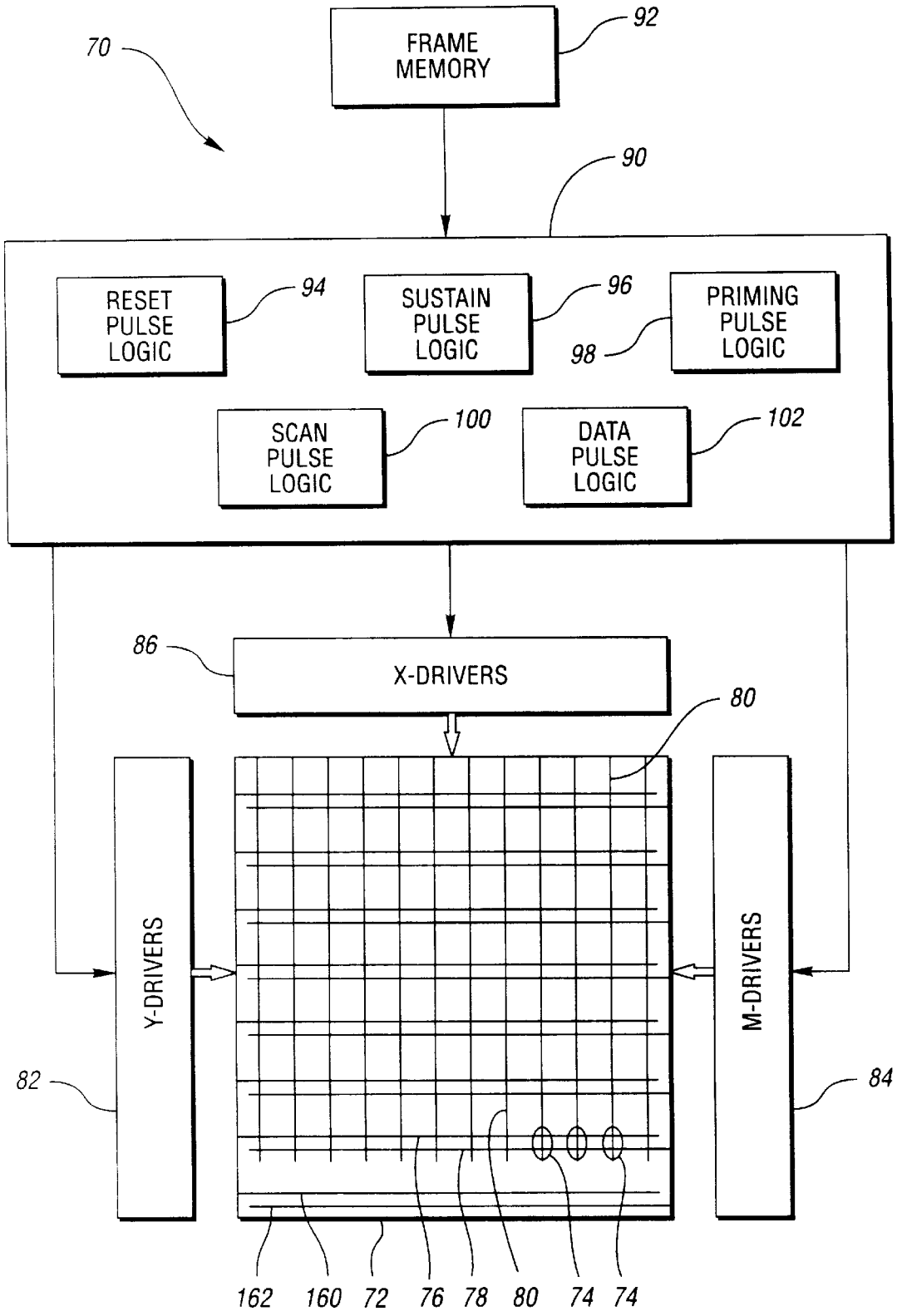
FIG. 4 is a block diagram illustrating a plasma display panel and associated driver circuitry in a system of the present invention.
Figure 6:
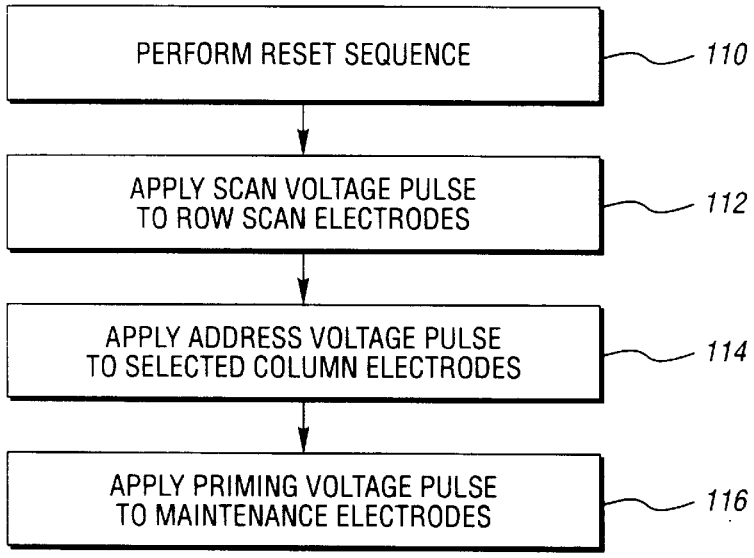
FIG. 6 is a block diagram illustrating a method of the present invention for driving a plasma display panel.

Referring to FIG. 4, a system for driving a plasma display panel is generally indicated at 70. A plasma display panel 72 has a plurality of display lines composed of pixels 74. For simplicity, only a few of the pixels 74 are specifically illustrated. As shown, plasma display panel 72 is of the surface discharge type having row electrodes which include row scan electrodes 76 and maintenance electrodes 78. Plasma display panel 72 also includes a plurality of column or address electrodes 80. Pixels 74 are defined at cross-points of the column electrodes 80 with the scan electrodes 76 and corresponding maintenance electrodes 78. Each scan electrode 76 is paired with a corresponding maintenance electrode 78; and, each pixel 74 is capable of retaining a charge quantity also referred to as a wall charge. The electrodes are disposed in the gap region defined by front and back substrates positioned together as described previously.

Scan electrodes 76 are each independently driven by Y-drivers 82. The Y-drivers 82 may include an arrangement of pull-up and pull-down MOSFETS for driving scan electrodes 76 to desired voltages during panel operation. Similarly, maintenance electrodes 78 are driven by M-drivers 84 which may include an arrangement of pull-up and pull-down MOSFETS for driving maintenance electrodes 78 to desired voltages during panel operation. The maintenance electrodes 78 may all be connected in common with each other. Preferably, the maintenance electrodes 78 are divided into several groups, with each electrode in a particular group connected in common such that each individual group may be independently driven by M-drivers 84. For example, maintenance electrodes 78 may be separated into a first group of commonly driven electrodes for the even display lines, and a second group of commonly driven electrodes for the odd display lines. By providing several groups of common maintenance electrodes 78, different portions of the plasma display panel 72 may be sustained independent of each other, and/or may be driven at different phases with respect to each other. Utilizing several independent groups of maintenance electrodes enhances electronic designs, including energy recovery and power management techniques. Further, each address electrode 80 is independently driven by X-drivers 86 to allow row-by-row pixel selection during addressing. X-drivers 86 may also include an arrangement of pull-up and pull-down MOSFETS for driving address electrodes 80 to desired voltages during panel operation.

As shown plasma display panel 72 is of the surface discharge type panel construction. It is to be appreciated that embodiments of the present invention may operate panel 72 in a surface discharge mode or a column discharge mode, while providing discharge priming during the addressing period.

The Y-driver circuitry 82, M-driver circuitry 84, and X-driver circuitry 86 are each controlled by driver circuitry 90 which receives pixel information from a frame memory 92. Driver circuitry 90 preferably includes one or more application specific integrated circuits (ASICs) for implementing control logic to process data received from the frame memory 92. Driver circuitry 90 sends control signals to Y-driver circuitry 82, M-driver circuitry 84, and X-driver circuitry 86 to drive the plasma display panel 72. Alternatively, the driver circuitry 90 may comprise components which implement control logic via software, firmware, hardware, microcode, or any combination of control logic implementation methods known in the art; however, one or more ASICs are used in the preferred embodiment.

As illustrated, driver circuitry 90 includes one or more components, which preferably include one or more ASICs, for performing reset pulse logic 94, sustain pulse logic 96, priming pulse logic 98, scan pulse logic 100, and data pulse logic 102.

With continuing reference to FIG. 4, in both surface discharge operation and column discharge operation of plasma display panel 72, images are displayed in a series of frames. The pixel data is obtained by driver circuitry 90 from frame memory 92. Frame memory 92 receives a digital signal which may be a digital video signal or an analog video signal that has been converted to a digital signal. The frames are typically displayed at a rate of 60 frames per second; however, other display rates may be used depending on the pixel data and the driver circuitry capabilities. Further, each frame includes a plurality of subframes.

Each subframe includes an addressing period during which display lines are scanned to retain charge quantities on the selected pixels of the display lines. Further, each subframe includes a maintenance period during which the stored charge quantities or wall charges are sustained to illuminate the selected pixels which have stored charge quantities thereon.

Figure 5:
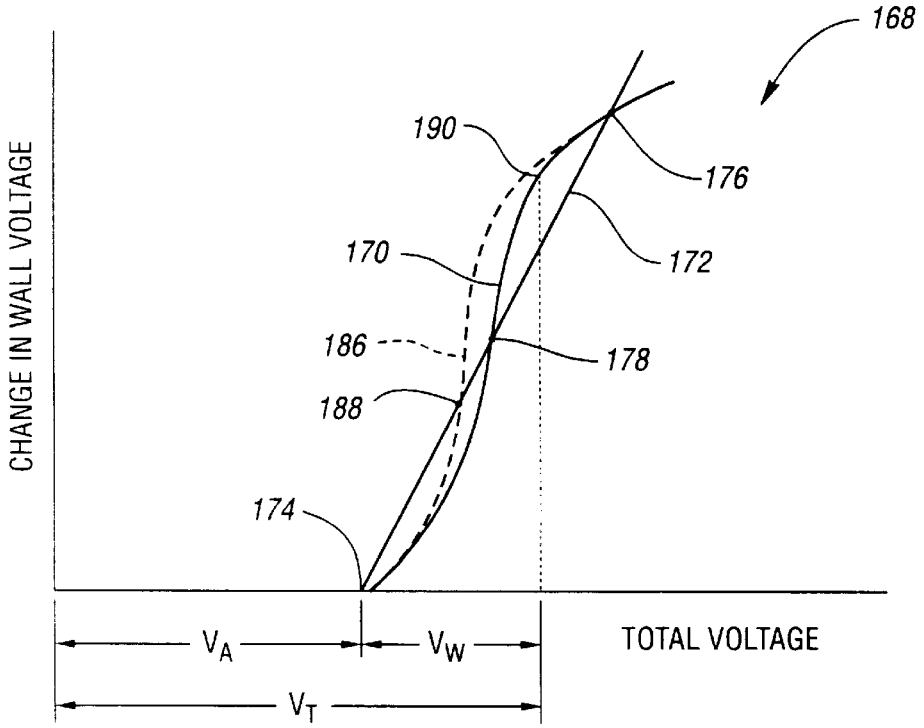
FIG. 5 is a graph depicting a representative bi-stable voltage transfer curve and locus of equilibrium points for a plasma display panel.

With reference to FIG. 5, a graph depicting a representative bi-stable voltage transfer curve and locus of equilibrium points for a plasma display panel is generally indicated at 168. The storing, removing, and sustaining of charge quantities, or wall charges, will now be described in detail.

The abscissa of graph 168 indicates total voltage across a pixel. The total voltage, $V_T$, across a pixel is equal to the sum of the applied voltage, $V_A$, between the electrodes, namely the scan and maintenance electrodes or scan and address electrodes, and the wall voltage, $V_W$, due to any existing wall charge on the pixel. The ordinate of graph 168 indicates the magnitude of change in wall voltage occurring at discharge of the pixel, if the total voltage, $V_T$, is sufficient to cause a discharge. A voltage transfer curve 170 determines the change in wall voltage at discharge as a function of the total voltage, $V_T$, across a pixel. Pixel 190 represents an exemplary total voltage, $V_T$, applied voltage, $V_A$, and wall voltage $V_W$.

A locus of equilibrium points 172 represents a line at which the change in wall voltage has a slope of 2. A slope of 2 means that at points of transfer function 170 located on the equilibrium locus 172, a pixel discharge results in the wall voltage, $V_W$, reversing polarity while maintaining its magnitude. The locus 172 intersects the voltage transfer curve 170 at first and second stable equilibrium points 174 and 176, respectively. Point 174 represents a pixel in the "off" state, that is, a pixel having all wall charge removed. Point 176 represents a pixel in the "on" state, that is, a pixel having a full wall charge for subsequent illumination of the pixel.

Further, voltage transfer curve 170 has an unstable equilibrium point 178. As illustrated by FIG. 5, iterative applications of an applied voltage across a pixel in which the total voltage including applied and wall voltage falls to the right of point 178 on transfer curve 170 causes the wall charge to increase until a full wall charge (point 176) is obtained. Iterative applications of an applied voltage across a pixel in which the total voltage including applied and wall voltages falls to the left of point 178 on transfer curve 170 causes wall charge to decrease until all wall charge is removed (point 174).

With continuing reference to FIG. 5, discharge priming of a bi-stable plasma display panel affects the voltage transfer curve 170. Particularly, discharge priming causes the unstable equilibrium point to move along the locus 172 toward the pixel "off" stable equilibrium point 174. A voltage transfer curve of a discharge primed plasma display panel is indicated in dashed line at 186. The unstable equilibrium point of the primed panel is indicated at point 188. The primed panel may be driven with reduced pulse widths because in addition to altering the shape of the transfer function, discharge priming reduces the formative discharge time lag for the pixels.

In order to store a charge quantity to a pixel from which the charge quantity has previously been removed, it is necessary to apply a voltage between the row scan electrode and the column address electrode that exceeds a breakdown voltage, $V_{bd}$, which corresponds to the unstable equilibrium point (point 188 in a primed panel, point 178 in an unprimed panel) to cause an addressing discharge which deposits a charge quantity or wall charge at the pixel to reduce an effective voltage across the sustain discharge gap.

Once a charge quantity is stored to a pixel, a sustain voltage applied across the pixel having an opposite polarity of the pixel voltage due to the charge quantity, and greater than a minimum sustaining voltage, $V_n$, which corresponds to stable equilibrium point 174, causes another discharge which reverses the polarity of the pixel voltage. An AC sustaining voltage applied across the pixel will cause the pixel voltage polarity to oscillate, illuminating the pixel. In accordance with the present invention, pixels may be sustained in a surface discharge sustaining mode or a column discharge sustaining mode.

When storing a charge quantity on a pixel of a plasma display panel, the pixel may require a few sustain pulses before reaching the full pixel "on" state. The requirement for storing a charge to a pixel is that the initial discharge results in sufficient wall voltage such that the subsequently applied voltage and wall voltage are sufficient to establish a total pixel voltage which falls to the right of the unstable equilibrium point of the voltage transfer curve.

In order to remove a charge quantity from a pixel to which the charge quantity has previously been stored, it is necessary to cause a partial discharge across the pixel. The partial discharge is achieved by applying a sustain voltage across the pixel having an opposite polarity of the pixel voltage due to the charge quantity, and greater than the minimum sustaining voltage, $V_n$, to cause a partial discharge which reduces the magnitude of the wall charge. A partial discharge is achieved by applying a lower voltage than that applied for pixel sustaining and/or shortening the pulse width of voltage application.

While addressing plasma display panels, it is desirable to decrease the formative discharge time lag or time delay between selective addressing voltage application and associated addressing discharge. One way to decrease this time lag is to increase the applied voltage. The preferred way to reduce this time lag is to reduce the breakdown voltage via discharge priming. Discharge priming techniques of the present invention both reduce the addressing time per line and increase the reliability of the address discharges to effectively address the pixels by causing the unstable equilibrium point of the voltage transfer curve to operate at a point (such as point 188) which is toward the left of the corresponding unstable equilibrium point (point 178) of an unprimed panel.

Another important feature of plasma display panels is gray scaling: To achieve gray scaling, a frame is divided into a number of subframes. Each subframe includes a reset period, an addressing period, and a sustaining period. The time length of the sustaining periods in different subframes varies such that a pixel may be illuminated for varying amounts of time during a single frame by illuminating the pixel during some subframes and not during others. For example, 8-bit gray scaling or 256 intensity level gray scaling may be achieved, for example, by employing eight subframes having relative sustained period lengths of 1-2-4-8-16-32-64-128, respectively. Various methods may be utilized to reduce display disturbances by reassigning the subfield lengths and sequence. For example, subframe lengths of 48-48-1-2-4-8-16-32-48-48 may be employed to achieve 8-bit gray scaling. Because each subframe must include an addressing period, it is desirable to reduce the addressing time per line to allow more lines to be addressed to accommodate high definition display panels having 1080 or more display lines.

With reference to FIGS. 6 and 7*a*–7*d*, a first method of the present invention for driving a plasma display panel is illustrated. It is to be understood that the waveforms shown in FIGS. 7*a*–7*d* represent a first embodiment of the present invention, and that there are many variations of the driving systems and methods described herein which would be appreciated by one of ordinary skill in the art.

Figure 7A:
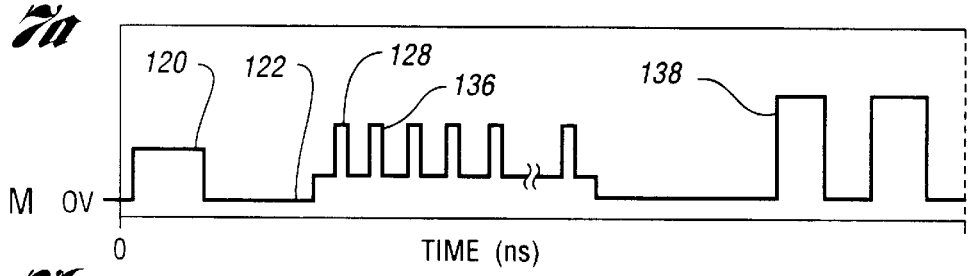
FIG. 7*a* is a graph depicting a driving waveform for a maintenance electrode in a first embodiment of the present invention.
Figure 7B:
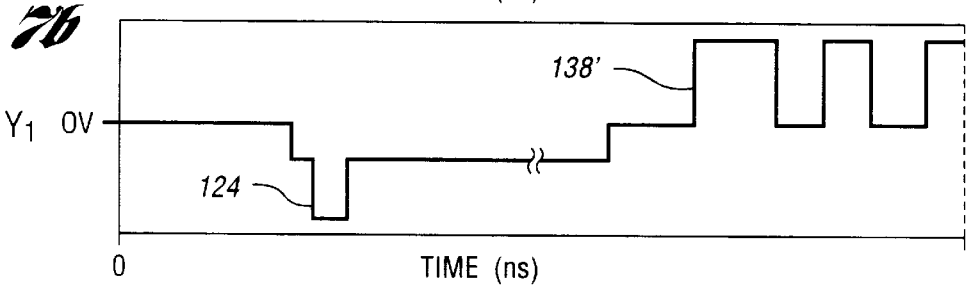
FIG. 7*b* is a graph depicting a driving waveform for a first scan electrode in a first embodiment of the present invention.
Figure 7C:
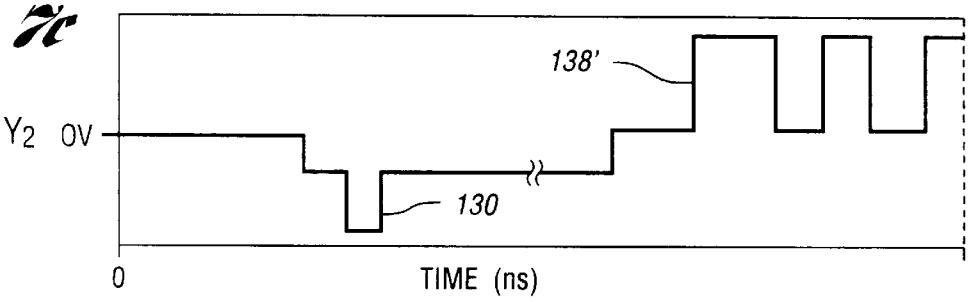
FIG. 7*c* is a graph depicting a driving waveform for a second scan electrode in a first embodiment of the present invention.
Figure 7D:
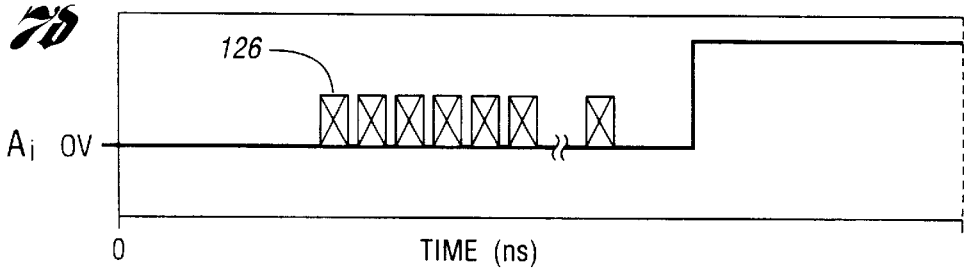
FIG. 7*d* is a graph depicting a driving waveform for column addressing electrodes in a first embodiment of the present invention.

FIG. 7*a* illustrates the voltage waveform applied to the maintenance electrodes. FIG. 7*b* illustrates the voltage waveform applied to the first row scan electrode. FIG. 7*c* illustrates the voltage waveform applied to the second row scan electrode. The remaining row scan electrodes are driven by the associated Y-driver and have waveforms similar to those shown in FIGS. 7*b* and 7*c*. FIG. 7*d* illustrates the voltage waveform applied to the column addressing or data electrodes. Each of these waveforms and the significance of each voltage pulse of each waveform will now be described.

At step 110, a reset sequence is performed to remove charge quantities retained by the pixels from a previous frame. As shown, the row scan electrodes and the column addressing electrodes are held at 0 volts, or the common ground, by Y-drivers 82 and X-drivers 86, respectively. M-drivers 84 drive the maintenance electrodes with a bulk erase pulse 120 of preferably about 115 volts. In accordance with the present invention, the bulk erase pulse 120 is about 10 microseconds in duration. Thereafter, the maintenance electrodes are pulled to 0 volts for a conditioning time 122 of preferably about 10 microseconds which is sufficient to allow the excited charge particles to settle sufficiently for reliable addressing to begin. Proximate to the end of the conditioning time 122, the row scan electrodes are each pulled down to about −75 volts, and the maintenance electrodes are pulled up to about 60 volts.

At step 112, scan voltage pulses are applied to the row scan electrodes. As shown in FIG. 7*b*, the first row scan electrode is pulled down with a scan voltage pulse 124 of about −160 volts. While the first scan electrode is held low at about −160 volts, the other row scan electrodes, such as the second row scan electrode shown in FIG. 7*c*, remain at about −75 volts. Preferably, M-drivers 84 and X-drivers 86 are ground based, while Y-drivers 82 comprise a ground based bulk Y-driver for supplying the −160 volts, and a plurality of independent row Y-drivers based on the bulk Y-driver for supplying the +85 volt pulses to bias a row scan electrode to the −75 volts.

At step 114, addressing voltage pulses 126 are applied to selected column electrodes. As shown in FIG. 7*d*, a column address electrode corresponding to a pixel to be addressed receives an address voltage pulse 126 which pulls the address electrode up to about 65 volts. The voltage difference between the first row scan electrode and the selected column electrode is then equal to about 225 volts which exceeds the breakdown voltage for the gas discharge region.

As best shown in FIG. 3 for a surface discharge plasma display panel, the addressing discharge indicated by arrow 140 causes positively charged particles 142 to build up around the scan electrode 30, and negatively charged particles 144 to build up around the address electrode 42.

With continuing reference to FIGS. 6 and 7*a*–7*d*, an unselected pixel has a corresponding column electrode which is held at 0 volts. The voltage difference between an unselected column electrode and the first row scan electrode is then about 160 volts, which is less than the breakdown voltage and does not cause an addressing discharge. In the manner described above, all of the pixels defined along the first row electrode may be simultaneously selectively written.

While the first row scanning electrode is held at the scan voltage, the maintenance electrodes are biased to about 60 volts. Proximate to the end of scan pulse 124, a priming voltage pulse 128 is applied to the maintenance electrodes. The priming voltage pulse 128 is preferably about 70 volts, which pulls the maintenance electrodes up to about 130 volts. As best shown in FIG. 3, the priming pulse 128 causes a priming surface discharge indicated by arrow 146 which excites charge particles in the surrounding areas including nearby row scan electrodes for different display lines and their discharge regions. The excited particles provide discharge priming for the nearby rows of different display lines, particularly the adjacent rows. The excited particles may further provide discharge priming between columns via indents 60 in barrier ribs 40. The discharge priming reduces the formative discharge time lag for the primed rows by effectively reducing the breakdown voltage, $V_{bd}$, to about 210 volts for the discharge regions of the nearby rows and particularly the adjacent rows. For this reason, the duration of the scanning and addressing pulse widths may be reduced from about 3.5 microseconds to about 1.5 microseconds without increasing voltages. By increasing voltages, scanning and addressing pulse widths may be reduced to as low as 0.5 microseconds.

As best shown in FIG. 3, preferably, the priming discharge 146 is sufficient to enhance the storing of the charge quantity on the pixel by causing positively charged particles 142 to build up around the scan electrode 30, and negatively charged particles 148 to build up around the maintenance electrode 50. Because the unselected pixels have column address electrodes which are at about 0 volts, surface discharge occurring there results in negligible wall charge build up which falls to the left of the unstable equilibrium point on the transfer function, as previously described with reference to FIG. 5. However, the surface discharge does generate priming particles sufficient to facilitate addressing of nearby lines, particularly adjacent lines. To keep any wall charge on unselected pixels negligible, priming pulse 128 has a narrow pulse width. The priming pulses may also be enhanced by priming from a previously scanned display line.

With continuing reference to FIGS. 6 and 7*a*–7*d*, in a preferred embodiment, the scanning and addressing pulse widths are about 1.5 microseconds, and the priming pulse widths are preferably about 700 nanoseconds and are preferably positioned with respect to the scan pulse 124 to end proximate the end of the scan pulse to provide maximum priming of the next display line to be scanned. The representative pulse widths and voltages stated in the preceding description are used in a preferred embodiment of the present invention. It is to be appreciated that the voltages and pulse widths may be adjusted to meet desired design criteria, such as minimal switching voltages, or minimal addressing time per line. Embodiments of the present invention utilize voltages and pulse widths to cause a priming discharge between a pair of row electrodes during panel addressing, and may be achieved in a variety of ways, a preferred embodiment being described above.

With continuing reference to FIGS. 6 and 7*a*–7*d*, because the priming discharge is a surface discharge between a row scan electrode and a maintenance electrode, the excited particles disperse through the troughs between the barrier ribs, priming nearby display lines. In a preferred embodiment, as best shown in FIG. 3, excited particles may also disperse themselves through indents 60 to provide priming between adjacent columns. In a monochrome plasma display panel, wherein there are no barrier ribs, the priming particles may freely disperse throughout the gap region. The grouping of maintenance electrodes into parallel busses, as mentioned previously, allows individualized priming pulses to specific groups of lines being scanned. Individualized pulsing may be advantageous for energy recovery and power management.

Further, in a preferred embodiment, a starter electrode pair including first and second electrodes 160 and 162, respectively, are located proximate a first line to be scanned. The first line to be scanned may be the first line of the panel to be scanned or the first line to be scanned in a particular group of lines having maintenance electrodes in common. The starter electrode pair is non-addressable, and serves to prime the first line and other nearby lines to be scanned; the first scanned line is then used to prime the next lines and so on. Starter electrode pairs may be located anywhere in the panel to provide improved priming as desired.

After the first row of the plasma display panel has been scanned, the second row electrode is pulled down to the scanning voltage with a scan voltage pulse 130 of about −160 volts. The second electrode scan pulse 130 is performed, and the column address electrodes are selectively pulled high to write to selected pixels within the second row. A priming voltage pulse 136 is then applied to the maintenance electrode to prime other nearby lines, particularly the next line of the plasma display panel. Line-by-line scanning and priming continues until the desired lines to be scanned have been scanned. Alternatively, the priming voltage pulses may be applied to every other display line, or in other configurations including panels having one or more starter electrode pairs throughout the panel, or panels in which the maintenance electrodes are in several parallel bussed groups in which one or more groups are primed at a time.

At the completion of the addressing period of the subframe, those pixels having a charge quantity stored thereon are illuminated during the sustaining period. The sustaining pulses are applied between the row electrodes and the corresponding maintenance electrodes in a surface discharge plasma display panel, and between the row electrodes and the column electrodes in a column discharge type panel.

In a preferred embodiment for a surface discharge panel, the maintenance electrodes are oscillated between 0 volts and sustain pulses 138 of about 170 volts. The row electrodes are also oscillated between 0 volts and sustain pulses 138' of about 170 volts, which are 180° out of phase with the maintenance electrode sustain pulses 138. This scheme provides a voltage of about 170 volts between row electrodes and corresponding maintenance electrodes which exceeds the minimum sustaining voltage, $V_n$, which is about 160 volts and is determined by the gas mixture, dielectric layers, cell geometry, and gas-pressure. The sustain voltage oscillates in polarity to cause the pixel voltage due to the charge quantities to oscillate in polarity, illuminating the pixel. During the maintenance period, the addressing electrodes are held at about 80 volts.

It is to be appreciated that the present invention improves discharge priming and panel addressing, by consistently reducing the formative discharge time lag for scanning a display line of a plasma display panel. Further, the novel panel addressing scheme allows for a resetting sequence which includes a bulk erase at about 115 volts. The reset sequence of the present invention operates at voltages significantly lower than conventional resetting sequences which typically employ pulses of about 340 volts. The improved reset sequence, which results from the novel addressing and priming scheme, utilizes lower switching voltages for the electrode driver circuitry, which significantly decreases the cost of driver circuitry including ASICs, and driving MOSFETS.

Further, it is to be appreciated that the novel resetting scheme utilized by embodiments of the present invention decreases background glow due to extensive conditioning discharge found in conventional driving techniques, allowing for a higher contrast ratio display.

Figure 8A:
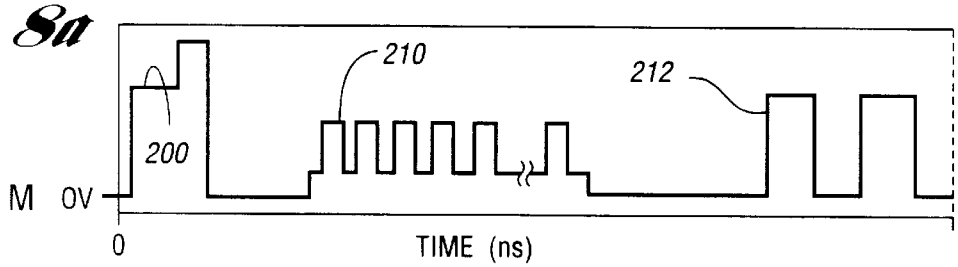
FIG. 8*a* is a graph depicting a driving waveform for a maintenance electrode in a second embodiment of the present invention.
Figure 8B:
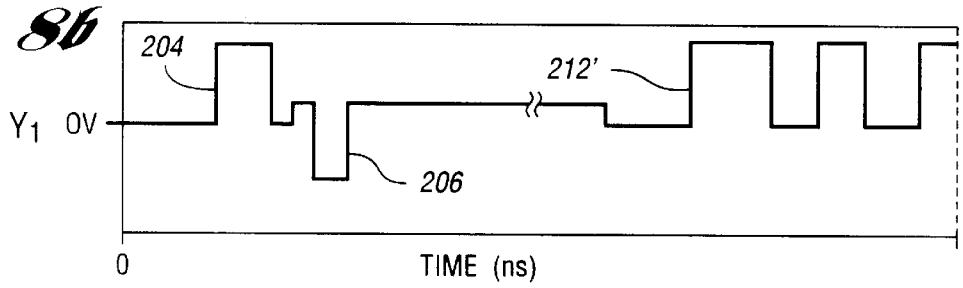
FIG. 8*b* is a graph depicting a driving waveform for a first scan electrode in a second embodiment of the present invention.
Figure 8C:
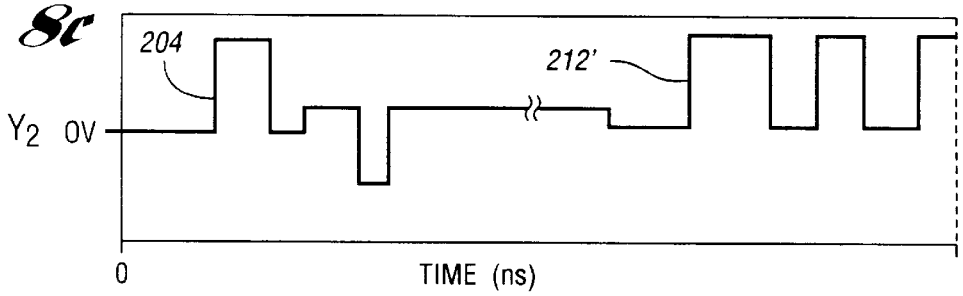
FIG. 8*c* is a graph depicting a driving waveform for a second scan electrode in a second embodiment of the present invention.
Figure 8D:
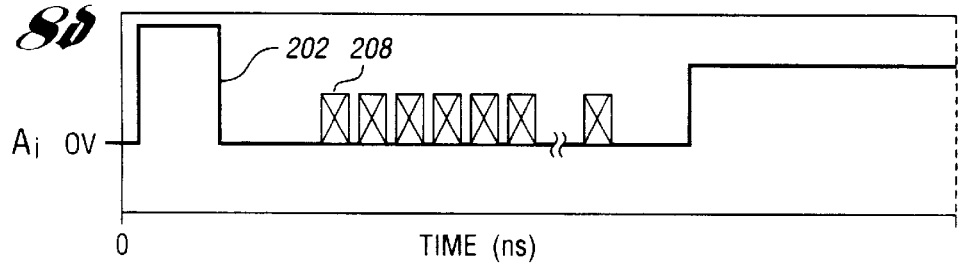
FIG. 8*d* is a graph depicting a driving waveform for column addressing electrodes in a second embodiment of the present invention.

With reference to FIGS. 6 and 8*a*–8*d*, a second method of the present invention is illustrated. FIG. 8*a* illustrates the voltage waveform applied to the maintenance electrodes. FIG. 8*b* illustrates the voltage waveform applied to the first row scan electrode. FIG. 8*c* illustrates the voltage waveform applied to the second row scan electrode. The remaining row scan electrodes are driven by the associated Y-driver and have waveforms similar to those shown in FIGS. 8*b* and 8*c*. FIG. 8*d* illustrates the voltage waveform applied to the column addressing or data electrodes. Each of these waveforms and the significance of each voltage pulse of each waveform will now be described.

At step 110, a reset sequence is performed to store quantities retained on the pixels. As shown, the row scan electrodes are held at 0 volts, and the column addressing electrodes are driven with a pulse 202 of about 130 volts. M-drivers 84 drive the maintenance electrodes with a bulk write pulse 200 having a 170 volt component followed by a 290 volt component. Thereafter, the scan electrodes are driven with a sustaining pulse 204 to enhance the charge storing.

In the addressing period, the maintenance electrodes are biased to about 40 volts, while the scan electrodes are biased to about 25 volts. In a manner similar to that described for the embodiment illustrated in FIGS. 7*a*–7*d*, scan pulses 206 of about −85 volts, which result in a total bias of −60 volts, cooperate with addressing pulses 208 to remove the stored charge quantities from unselected pixels. An addressing pulse of about 65 volts for preferably about 1.5 microseconds is sufficient to remove a charge quantity from an unselected pixel as described previously with reference to FIG. 5. The scan pulses are preferably generated by the combination of a bulk driver and a plurality of row drivers as described previously. Proximate the end of the scanning and addressing pulses, 206 and 208 respectively, a priming pulse 210 of about 70 volts for preferably about 1.0 microseconds is applied to the maintenance electrodes to produce a voltage of about 110 volts on the maintenance electrodes which causes a priming discharge to occur. The priming voltage pulse 210 causes a maintenance discharge in the selected pixels. In the unselected pixels, any discharge results in negligible wall charge build up.

After panel addressing, a sustaining period includes maintenance electrode sustaining voltage pulses 212, and scan electrode sustaining pulses 212', which illuminate those pixels having a charge quantity stored thereon.

While the best mode for carrying out the invention has been described in detail, those familiar with the art to which this invention relates will recognize various alternative designs and embodiments for practicing the invention as defined by the following claims.

What is claimed is:

1. A method of driving a plasma display panel having a plurality of display lines composed of pixels defined at cross-points of row electrodes and column electrodes, each pixel being capable of retaining a charge quantity, the method comprising:

scanning a current display line of the plasma display panel to retain charge quantities on selected pixels defined along a first row electrode;

applying a priming voltage pulse between the first row electrode and a second row electrode to cause a priming discharge between the first and second row electrodes, the priming discharge being capable of priming a different display line of the plasma display panel proximate to the current display line, wherein the row electrodes comprise a plurality of scan electrodes and a plurality of maintenance electrodes, each scan electrode being paired with a maintenance electrode, the first row electrode being one of the scan electrodes, and the second row electrode being a maintenance electrode paired with the one of the scan electrodes such that the priming discharge occurs between the one of the scan electrodes and the maintenance electrode paired with the one of the scan electrodes, wherein the method further comprises:

applying sustaining voltage pulses between scan electrodes and corresponding maintenance electrodes to illuminate the selected pixels.

2. The method of claim 1 further comprising:

applying sustaining voltage pulses between row electrodes and column electrodes to illuminate the selected pixels.

3. A system for driving a plasma display panel having a plurality of display lines composed of pixels defined at cross-points of row electrodes and column electrodes, each pixel being capable of retaining a charge quantity, the system comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line, wherein the driver circuitry is configured for applying the priming voltage pulse while scanning the current display line; and driver circuitry for resetting the plasma display panel by storing charge quantities on the pixels prior to scanning display lines of the plasma display panel, for applying a scan voltage pulse to the first row electrode, and for applying an addressing voltage pulse to unselected column electrodes corresponding to unselected pixels of the current display line to cause an addressing discharge between the first row electrode and the unselected column electrodes, the addressing discharge removing charge quantities from the unselected pixels.

4. A system of driving a plasma display panel having a plurality of display lines composed of pixels defined at cross points of row electrodes and column electrodes, each pixel being capable of retaining a charge quantity, the system comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line, wherein the row electrodes comprise a plurality of scan electrodes and a plurality of maintenance electrodes, each scan electrode being paired with a maintenance electrode, the first row electrode being one of the scan electrodes, and the second row electrode being a maintenance electrode paired with the one of the scan electrodes such that the priming discharge occurs between the one of the scan electrodes and the maintenance electrode paired with the one of the scan electrodes, wherein the driver circuitry further comprises:

driver circuitry for applying sustaining voltage pulses between scan electrodes and corresponding maintenance electrodes to illuminate the selected pixels.

5. A system of driving a plasma display panel having a plurality of display lines composed of pixels defined at cross-points of row electrodes and column electrodes, each pixel being capable of retaining a charge quantity, the system comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line, and driver circuitry for applying sustaining voltage pulses between row electrodes and column electrodes to illuminate the selected pixels.

6. A plasma display panel including a pair of substrates positioned to define a gap region there-between, a plurality of row electrodes disposed in the gap region, and a plurality of column electrodes disposed in the gap region and cooperating with the row electrodes to form a plurality of display lines composed of pixels defined at cross-points of the row electrodes and the column electrodes, each pixel being capable of retaining a charge quantity, the plasma display panel further comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line, wherein the driver circuitry is configured for applying the priming voltage pulse while scanning the current display line, and driver circuitry for resetting the plasma display panel by storing charge quantities on the pixels prior to scanning display lines of the plasma display panel, for applying a scan voltage pulse to the first row electrode, and for applying an addressing voltage pulse to unselected column electrodes corresponding to unselected pixels of the current display line to cause an addressing discharge between the first row electrode and the unselected column electrodes, the addressing discharge removing charge quantities from the unselected pixels.

7. A plasma display panel including a pair of substrates positioned to define a gap region there-between, a plurality of row electrodes disposed in the gap region, and a plurality of column electrodes disposed in the gap region and cooperating with the row electrodes to form a plurality of display lines composed of pixels defined at cross-points of the row electrodes and the column electrodes, each pixel being capable of retaining a charge quantity, the plasma display panel further comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line, wherein the row electrodes comprise a plurality of scan electrodes and a plurality of maintenance electrodes, each scan electrode being paired with a maintenance electrode, the first row electrode being one of the scan electrodes, and the second row electrode being a maintenance electrode paired with the one of the scan electrodes such that the priming discharge occurs between the one of the scan electrodes and the maintenance electrode paired with the one of the scan electrodes; and driver circuitry for applying sustaining voltage pulses between scan electrodes and corresponding maintenance electrodes to illuminate the selected pixels.

8. A plasma display panel including a pair of substrates positioned to define a gap region there-between, a plurality of row electrodes disposed in the gap region, and a plurality of column electrodes disposed in the gap region and cooperating with the row electrodes to form a plurality of display lines composed of pixels defined at cross-points of the row electrodes and the column electrodes, each pixel being capable of retaining a charge quantity, the plasma display panel further comprising:

driver circuitry for scanning a current display line of the plasma display panel to retain charge quantities on selected pixels defined along a first row electrode, and for applying a priming voltage pulse between the first row electrode and a second row electrode to cause a priming discharge between the first and second row electrodes, the priming discharge being capable of priming a different display line of the plasma display panel proximate to the current display line; and driver circuitry for applying sustaining voltage pulses between row and column electrodes to illuminate the selected pixels.

* * * * *